United States Patent [19]

Tjebbes et al.

[11] Patent Number: 4,505,214

[45] Date of Patent: Mar. 19, 1985

[54] DREDGED SOIL CONVEYING VESSEL

[75] Inventors: Johannes C. Tjebbes; Tjako A. Wolters, both of Zeist, Netherlands

[73] Assignee: Ballast-Nedam Groep N.V., Amstelveen, Netherlands

[21] Appl. No.: 167,328

[22] Filed: Jul. 9, 1980

[30] Foreign Application Priority Data

Jul. 31, 1979 [EP] European Pat. Off. ..... 79200428.5

[51] Int. Cl.[3] ..... B63B 35/30

[52] U.S. Cl. ..... 114/29; 37/59; 406/39

[58] Field of Search ..... 114/26-30, 114/73; 37/58, 59; 406/38, 39

[56] References Cited

U.S. PATENT DOCUMENTS

| | | | |
|---|---|---|---|
| 1,495,428 | 5/1924 | Neveling | 114/29 |
| 3,606,038 | 9/1971 | Thomas et al. | 406/38 |
| 4,033,470 | 7/1977 | Venus et al. | 114/27 X |
| 4,160,618 | 7/1979 | Sensibar | 406/137 |

FOREIGN PATENT DOCUMENTS

| | | | |
|---|---|---|---|
| 159741 | 2/1904 | Fed. Rep. of Germany . | |
| 213798 | 9/1907 | Fed. Rep. of Germany . | |
| 2828018 | 2/1979 | Fed. Rep. of Germany . | |
| 2342889 | 9/1977 | France . | |
| 7611507 | 10/1976 | Netherlands . | |
| 1162085 | 8/1969 | United Kingdom | 114/29 |

*Primary Examiner*—Sherman D. Basinger

*Attorney, Agent, or Firm*—Diller, Ramik & Wight

[57] ABSTRACT

In a dredged soil conveying vessel comprising a hold which is open on the bottom side and which is enclosed between two pivotally interconnected ship's halves, each of which has floating power and joining one another along their bottom rims in the closed state, in order to provide many efficient modes of discharge of the dredged soil conveying vessel, one ship's half is provided near the bottom of the hold with a draining suction channel communicating with the hold through an opening that can be closed, said channel communicating with a pump connected with a slush outlet conduit and inside the hold of the dredged soil conveying vessel a plurality of water supplies are directed along the walls.

8 Claims, 25 Drawing Figures

Figure 1:
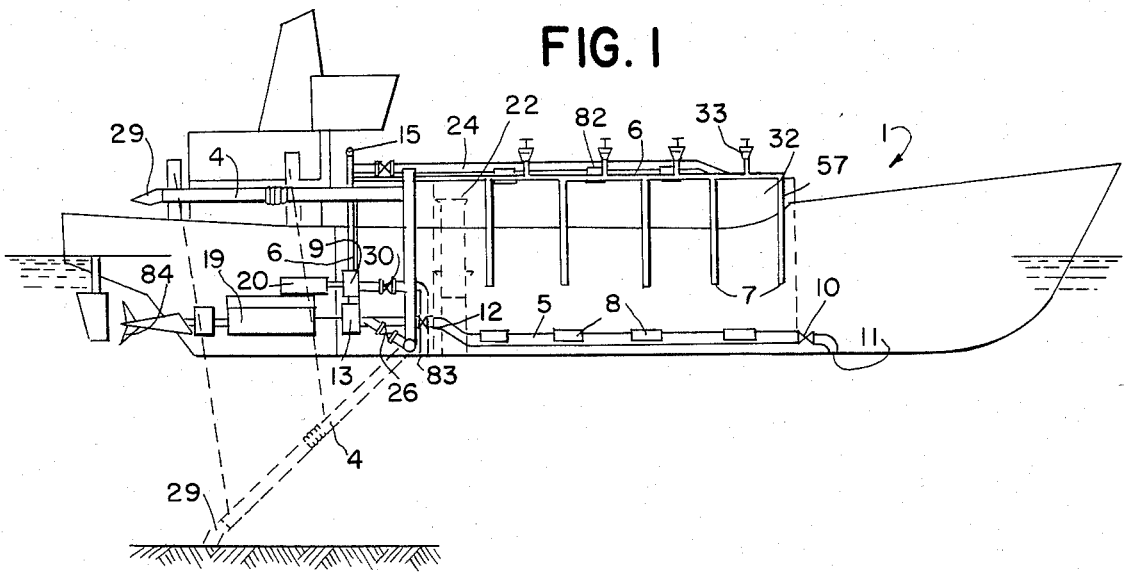

FIG. 16
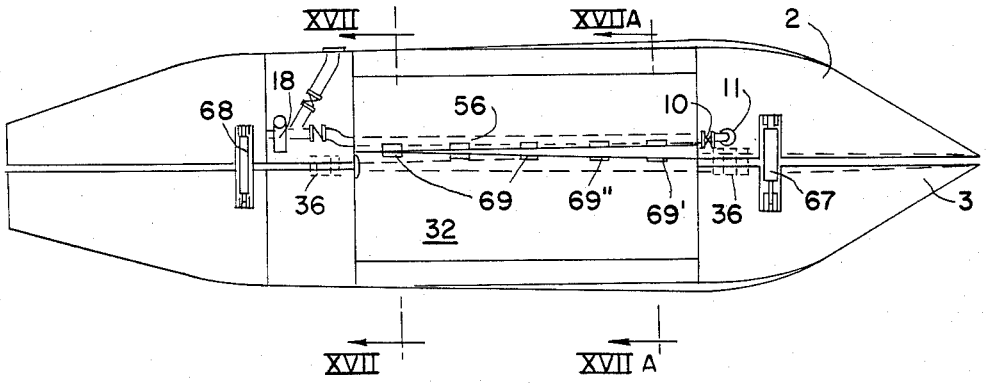
FIG. 17
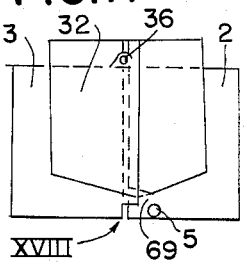
FIG. 17A
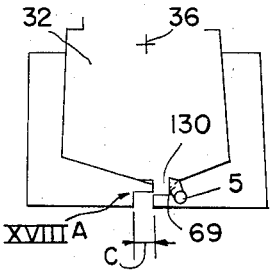
FIG. 18A
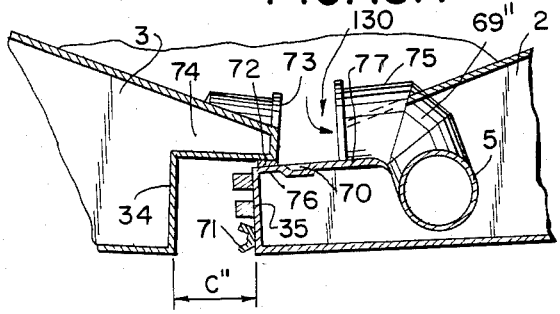
FIG. 18 B
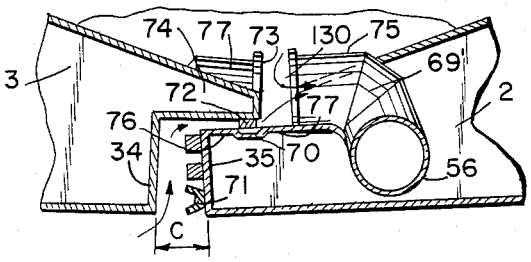
FIG. 18C
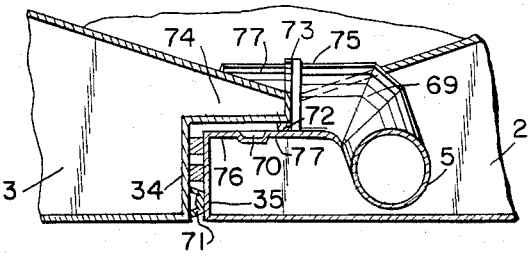
FIG. 19
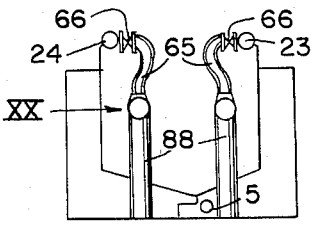
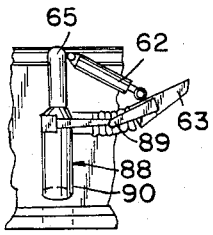
FIG. 20
FIG. 21
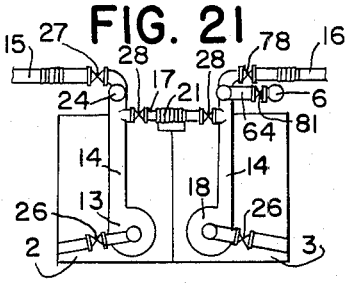

DREDGED SOIL CONVEYING VESSEL

The invention relates to a dredged soil conveying vessel comprising a hold for receiving dredged soil, for example sand, said hold being enclosed between two pivotally interconnected ship's halves, each of which has floating power and which join one another along the outsides of their bottom rims in the closed state, thus bounding the hold, said ship's halves being pivotable about a horizontal longitudinal axis out of the closed state into a discharging position, in which the hold is open on the bottom side and the cargo of dredged soil can be shed out of the hold past between the outsides of said two bottom rims, a discharge suction channel being arranged near the bottom of the hold and communicating with the hold through at least one opening that can be closed, said channel being connected with a pump connected with a slush outlet conduit.

Such a dredged soil conveying vessel is disclosed in German patent application No. 2,828,018. As such vessel requires a shallow draught and as the hold should have a great volume, the bottom walls of the hold may not slope steeply. When discharging the dredged soil through the large bottom opening after having pivoted the ship's halves into their discharging position the shape of the hold is changed so that the fairly slightly inclined bottom walls then have got a fairly steep slope, resulting in that the dredged soil slides easily downwards along the bottom walls through the large opening between the bottom rims. Owing to their shallow draught such vessels also permit of shedding in shallow water. If soil has to be transported to a place where it must not be shed on the bottom of the waterway, said known vessel may still be employed, but then the cargo is discharged through the discharge suction channel.

When discharging the cargo through the discharge suction channel the dredged soil does not easily move downwards in the direction of the opening of the discharge suction channel due to the fairly slightly inclined bottom walls. So, the discharge of the cargo through the discharge suction channel requires a long time period having intervals during which a suspension containing a high rate of water is pumped into the slush outlet conduit.

The invention has for its object to reduce the discharge time when discharging through the discharge suction channel. According to the invention this is achieved in that a discharge suction channel is positioned within at least one ship's half at the inner side of a bottom rim and in that in the hold of the vessel a plurality of water supplies is directed along the walls. By supplying water along the bottom walls the bridges of soil which could prevent the sand from moving downwards are disturbed. Those bridges of soil are particularly disturbed when pivoting the ship's halves relatively to each other over a small angle whilst maintaining the hopper sealed by a sealing strip provided on one of the ship's halves and forming a seal with respect to a horizontal sealing face on the other ship's half.

In the preferred dredged soil conveying vessel according to the invention a gap can be provided between the ship's halves for supplying additional water when the hold is emptied through at least one draining suction channel.

The above mentioned and further features of the invention will be described more fully hereinafter with reference to embodiments shown in the Figures.

Figure 2:
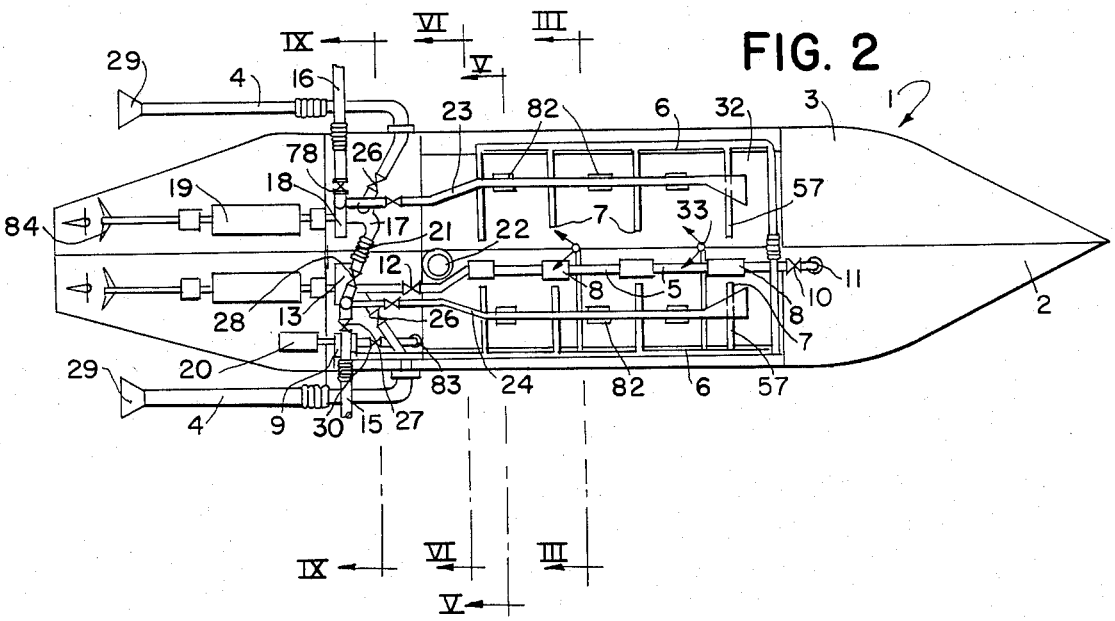
Figure 3:
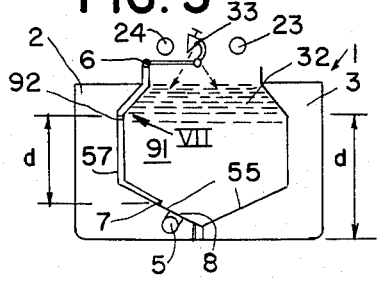
Figure 4:
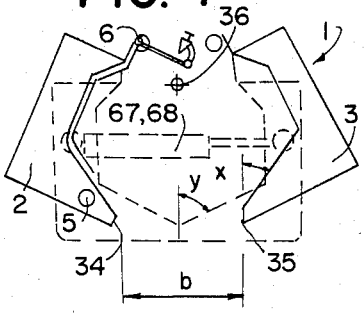
Figure 5:
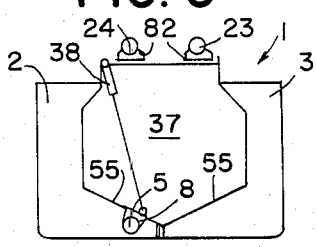
Figure 6:
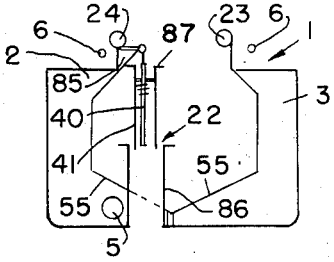
Figure 7:
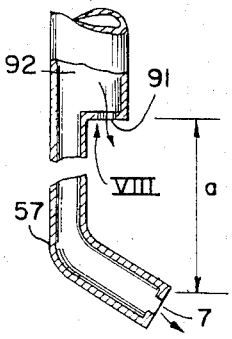
Figure 8:
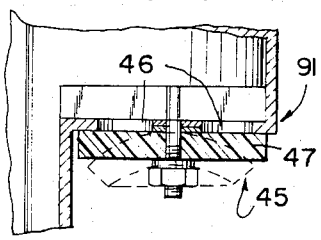
Figure 9:
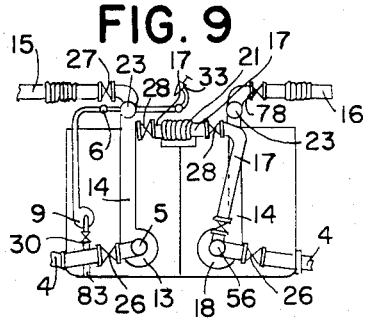
Figure 10:
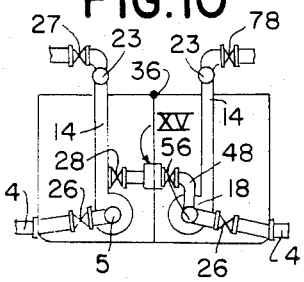
Figure 12:
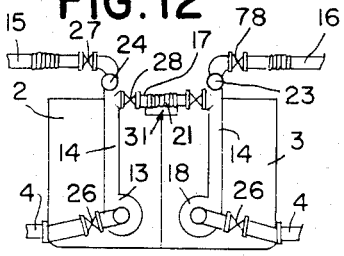
Figure 11:
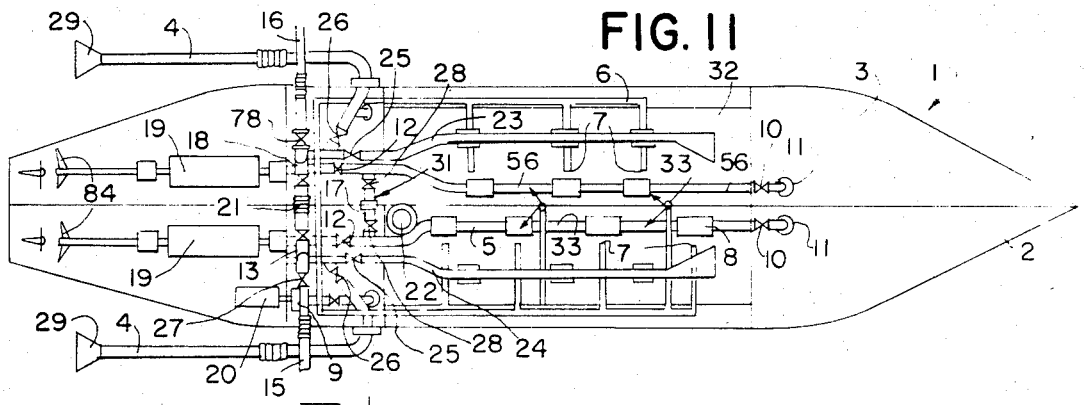
Figure 13:
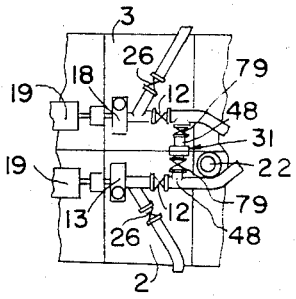
Figure 14:
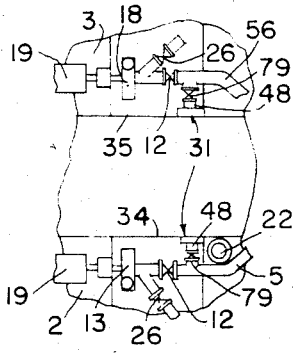
Figure 15:
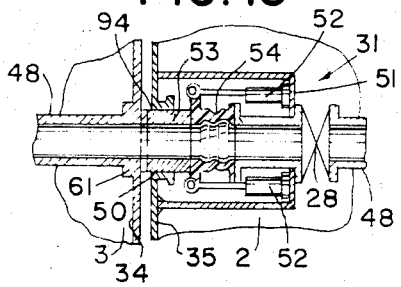
Figure 22:
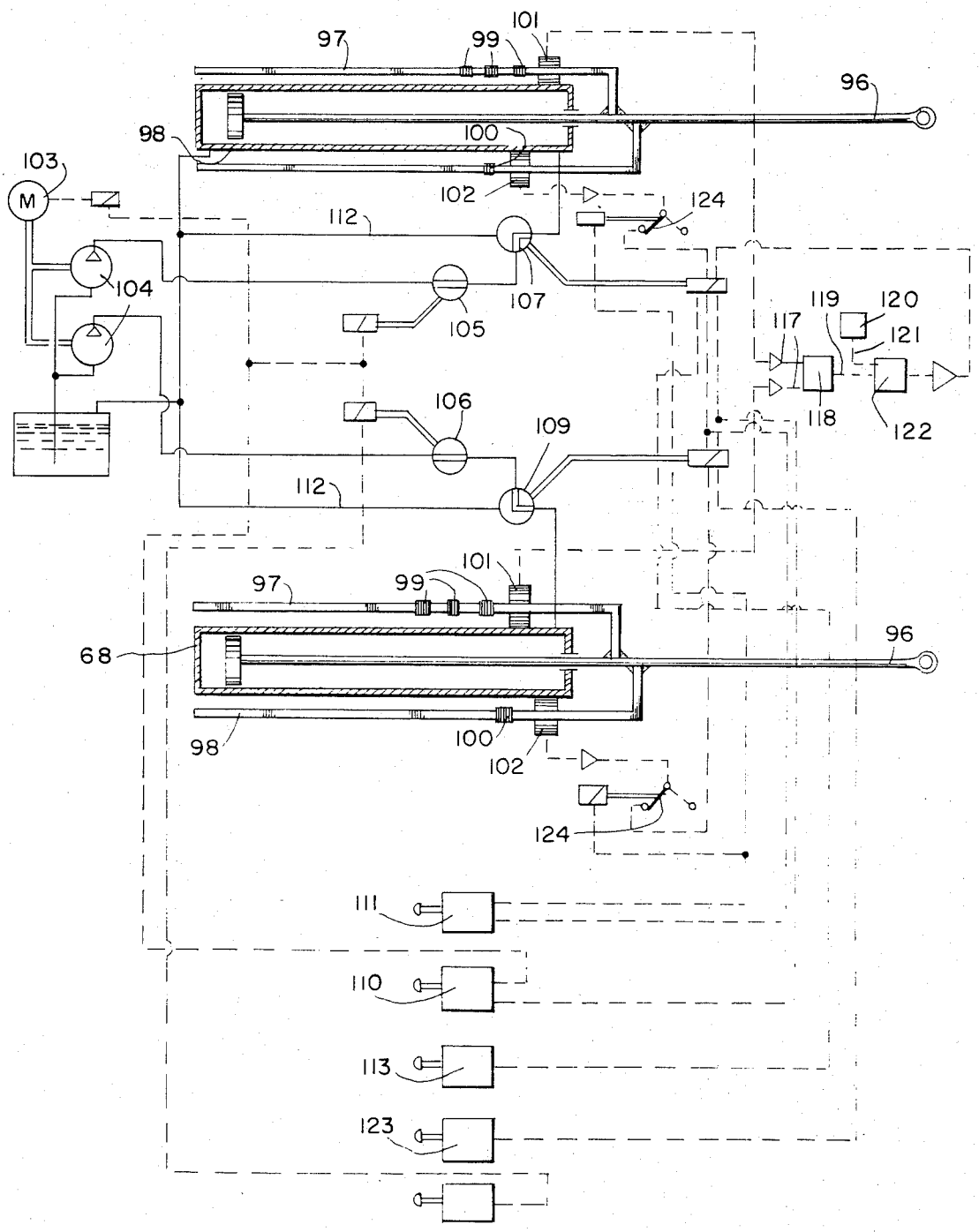

The drawing shows in:

FIG. 1 a side elevation of a dredged soil conveying vessel in accordance with the invention, FIG. 2 a plan view of a dredged soil conveying vessel as shown in FIG. 1, FIG. 3 a schematic cross-sectional view taken in the plane III—III in FIG. 2, FIG. 4 a similar cross-sectional view as FIG. 3, but in the traditional discharging state, FIGS. 5 and 6 cross-sectional views taken in the planes V—V and VI—VI respectively of FIG. 2, FIG. 7 on an enlarged scale detail VII of FIG. 3, FIG. 8 detail VIII of FIG. 7 on a further enlarged scale, FIG. 9 a sectional view taken in the plane IX—IX in FIG. 2, FIG. 10 a variant of the embodiment shown in FIG. 9, FIG. 11 a plan view of a further dredged soil conveying vessel in accordance with the invention in which as a variant of FIG. 2 a suction pipe is provided in each ship's half, FIG. 12 a sectional view taken in the plane XII—XII in FIG. 11, FIGS. 13 and 14 a variant of the coupling of draining suction channels in the coupled and discoupled states respectively, FIG. 15 on an enlarged scale detail XV of FIG. 10, FIG. 16 a plan view of a further developed, preferred embodiment of a dredged soil conveying vessel in accordance with the invention, FIGS. 17 and 17A sectional views taken in the planes XVII—XVII and XVIIA—XVIIA respectively of FIG. 16, FIG. 18C detail XVIII of FIG. 17 on an enlarged scale, FIG. 18A on an enlarged scale detail XVIIIA of FIG. 17A, FIG. 18B a position intermediate between those shown in FIGS. 18C and 18A, FIG. 19 a detail of the charge overflow, FIG. 20 detail XX of FIG. 19 on an enlarged scale, FIG. 21 a coupling of a water supply with a dredging pump, and FIG. 22 a simplified control-scheme.

Referring to FIGS. 1 and 2 the dredged soil conveying vessel 1 comprises two pivotally interconnected ship's halves 2 and 3, a hold 32 being left free between said floatable ship's halves 2 and 3 (see in particular FIGS. 3 to 6), which form, in their closed state shown in FIG. 3, a closed space 32 for dredged soil, for example sand, which can be discharged from the vessel 1 by causing, as shown in FIG. 4, the two ship's halves 2 and 3 to turn about a horizontal axis 36 in the longitudinal direction of the ship, a bottom opening b being thus formed, through which the dredged soil can leave the hold 32.

During said turn the angular position of the wall 55 changes from the angle y to the vertical into the angle x to the vertical, the wall 55 of the hold 32 being in the latter case in an appreciably steeper position with respect to the soil to be discharged than in the closed position so that no or hardly any bridge formation can occur in the hold 32. The floating power of the ship's halves 2 and 3 and the dimensions of the dredged soil conveying vessel 1 are such that the draught d in the loaded state is shallow.

In the embodiment shown in FIG. 1 the dredged soil conveying vessel 1 is constructed as a hopper dredger filling itself by suction, but obviously the dredged soil conveying vessel 1 may, as an alternative, have solely a transporting function, in which case the hold 32 is filled, for example beneath a scoop loader and the suction mechanism shown in FIGS. 1 and 2 comprising drag heads 29, drag pipes 4 and their connections with pumps 13 and 18 is omitted.

When this self-dredging device is employed, a suspension of water and dredged soil passes through the heads 29 and the piping 4 towards the pumps 13 and 18, then flows through the filling pipes 23 and 24 and passes along chutes 82 into the hold 32.

The dredged soil conveying vessel 1 according to the invention comprises a draining suction channel 5, which can communicate through a series of valves 8 with the hold 32 and which communicates at one end through a closing member 10 with an outboard water inlet 11 and at the other hand through a closing member 12 with the suction side of the pump 13.

In the simplest form only one half, for example, 2 of the dredged soil conveying vessel 1 according to the invention is provided with a draining suction channel 5 so that the soil together with water can be conveyed through the suction channel 5, the pump 13, the closing members 12 and 27 and the outlet conduit 15 to an outboard place of destination.

In order to ensure a satisfactory flow of dredged soil towards the valves 8, the hold 32 is provided with a water supply device, which in the simplest form only consists of a water supply pump 9 driven by an engine 20 and sucking in outboard water through a suction duct 83 having a closing member 30, said water being pressed through water mains 6 towards water nozzles 7 directed along the wall 55 so that the dredged soil deposited on the wall 55 can readily slide along said wall 55 and the formation of bridges during evacuation is avoided or at least drastically reduced.

In order to further improve the fluidisation of the dredged soil the water supply device comprises, in addition, movable spray nozzles 33, spraying water on top of the dredged soil contained in the hold 32 and thus pushing the dredged soil towards the suction duct 5 in cooperation with the water supplies 7.

In a "split" hopper comprising a double engine drive, a second dredged soil pump 18 is, as a matter of course, arranged in the other ship's half 3, said second dredged soil pump 18 communicating with its own draining channel 56 (see FIGS. 11 and 12) or through opened closing members 28 with a coupling conduit 17, which connects the compression side of the pump 13 with the suction side of the pump 18 in order to press away the dredged soil through a closing member 78 and an outlet conduit 16, for example, to a land pipe. The closing members 28 are then opened and the closing member 27 is closed. The engines 19 drive, according to need, preferably both the pump 18 or 13 respectively and the propellers 84.

In order to drain off the redundant quantity of water during loading the hold 32, it is preferred to use the draining device 22 shown in FIG. 6 comprising a console 85 connected with the ship's half 2, a hydraulic cylinder 40 suspended to the console 85 and a telescopic tube 41 secured to the cylinder 40 and being slidable in a sheath 86 secured to the ship's half 2 and communicating with the outboard water. The upper rim 87 thus forms a level-adjustable overflow rim for the hold 32.

FIG. 20 shows an alternative draining device 88 for redundant water during the loading operation, the level—adjustable rim of which is formed by an in-flow mouthpiece 63, which is pivotable by means of a hydraulic cylinder 62 about an axis 89 and which communicates through a sheath 90 with the outboard water.

The water is preferably directed at two different levels along the wall 55 towards the valves 8 of the draining suction channel 5, as is illustrated in particular in FIG. 3 and in FIGS. 7 and 8. With a level difference a above the water supplies 7 water inlet nozzles 91 are arranged and connected, all of them, with the water supply conduit 6. This embodiment comprises a thick tubing 92 with a mouthpiece 91 and a thin tubing 57 extending downwards away therefrom and having a water nozzle 7 on the lower side. In order to prevent fluidised sand from entering the tubing 57, the nozzles 7 and 91 are preferably provided each at their ends with a non-return valve 45 as shown in FIG. 8, which comprises a rubber flap 47 allowing water flowing out through the openings 46 to pass into the hold 32 along the wall 55, but preventing the penetration of soil into the tubing 57 or 92 respectively and hence preventing clogging thereof.

The valves 8 can be optionally opened by means of rods 37 and hydraulic cylinders 38.

Particularly in the embodiment shown in FIGS. 9, 11 and 12, in which two dredged soil pumps 13 and 18 are each connected with an individual suction pipe 4 and in which the two compression sides of said pumps can be connected with one another by coupling means 31 (FIG. 12), the pumps 13 or 18 arranged on board may be used differently. One suction pump 13 or 18 may even serve the two suction pipes 4 (FIG. 11). The coupling means 31 for the compression conduits 14 (FIG. 12) comprise an additional coupling conduit 17 with closing members 28 and a flexible part 21 arranged approximately at the level of the pivotal axis 36.

FIG. 21 shows the coupling conduit 64 for supplying water by means of the pump 18, the pump 9 being omitted. Outboard water is sucked in through the suction conduit 4, the opened closing member 26, the pump 18, the coupling conduit 64 and the closing member 81 in the water mains 6. If the water mains 6 supplies water along the two walls 55 of different ship's halves, the mains 6 should also have a flexible piping near the pivotal axis 36. In order to avoid an excessively large elevation on the suction side of the pump 13 or 18 at a location of the coupling means 31 of the suction pipe 4 at the area of the pivotal axis 36, when the two draining suction channels 5 and 56 are coupled by the coupling means 31 and the closing members 79 in coupling conduits 48, a coupling method as shown in FIGS. 13 and 14 illustrating the closed and opened state respectively of the dredged soil conveying vessel 1 is proposed near the bottom, in which the coupling conduits 48 including closing members 79 are coupled with one another with the aid of coupling means 31 as shown in FIG. 15. These coupling means 31 comprise a watertight compartment 51, in which a flexible tubing 54 is arranged, which can be displaced in its direction of length with the aid of hydraulic cylinders 52, whilst a pressing piece 53 provided with a sealing ring 50 can be shifted outwards through a fitting opening 94 from the lower rim 35 of one ship's half 2 against the seat 61 at the lower rim 34 of the other ship's half 3 so that the coupling conduits 48 in the two ship's halves 2 and 3 can communicate with one another. Such a coupling of the ship's halves 2 and 3 is advantageous with the suction piping as well as with the compression piping.

FIGS. 19 and 20 show details of the overflow device particularly useful at the beginning of the loading operation in order to minimize the amount of water in the hold 32, when this has to be charged with clay or mud, in which case the redundant quantity of water normally supplied together with the suspension is drained off as an overflow via the sheath 88 through the siphons 63 controlled by cylinders 62.

In the first stage of the suction process the soil dredged up with an excess amount of water is passed through the closing member 66 and the coupling conduit 65 directly from the supply conduit 23, 24 towards a sheath 88. The specific construction of the dredged soil conveying vessel 1 in the form of a split hopper is utilized in a further developed preferred embodiment for controlling the draining suction process. For this purpose the dredged soil conveying vessel 1 shown in FIG. 16 provided along the lower rim of one ship's half 2 with a draining suction channel 56, which can communicate through suction openings 69 (FIGS. 17 and 18) with the hold 32. The other ship's half 3 is provided with a nose rim 74, which joins a horizontal rim 76 of the other ship's half 2 on the lower side in a watertight manner by means of the seal 72. In the closed state the main seal is ensured by the seal 71 between the lower rims 34 and 35. In order to ensure a satisfactory seal of the in-flow openings 69 they are locally provided with cover plates 75 and 77, which can join one another in a watertight manner by means of a seal 73.

For carrying out a further developed method of operation power implements formed by hydraulic cylinders 68 and 67 serving to open and close respectively the dredged soil conveying vessel 1 are independently controllable so that the cylinder 68 can open the hold 32 at the one end concerned a predetermined small path, whereas the other cylinder 67 still holds the other end in the closed state.

The operation is as follows:

At the start of the draining suction operation a closing member 10 is opened and the suction pump 18 takes in outboard water. The cylinder 67 is then energized (or released respectively) over a small part of the trajectory so that the opening 69' (FIG. 18B) is released by a shift relative to the nose 74 over an adequate distance for admitting sand into the inflow opening 69', this sand being then conducted away through the evacuation channel 56. The gap 130 of the ship's halves 2 and 3 is indicated in FIGS. 17A, 18A, 18B and 18C. Then soil will flow from the hold 32 into the inlet 69 of the suction channel 56, which can conduct away in the manner described above the incoming sand-water mixtures through the pump 18. In addition, outboard water is sucked in through the inlet 11, which is controlled by the controllable closing member 10. Since the seal 72 at the water channel 70 (FIG. 18B) is no longer closed, outboard water is added at the area of the inlet opening 69 between the lower rims 34 and 35. When the dredged soil conveying vessel 1 is further opened, the seal 72 engages the closing rim 76, the distance between the lower rims 34 and 35 then being c''. In dependence upon the quantity of additional water in the successive stages through the water inlet 70 the closing member 10 is opened to a greater or lesser extent. However, in the final position c'' (FIG. 18A) as stated above, it again blocks the incoming water through the seal 72 and the sealing rim 76. The opening 69 is covered on the top side by a cover plate 75 which sealingly engages the cover plate 77 of the nose rim 74 by means of the seal 73.

As shown in the diagram of FIG. 22 only illustrating the control-elements required for a good understanding of the operation, the piston rods 96 of the hydraulic rams 67 and 68 have each two feeler arms 97 and 98 carrying trigger elements 99 and 100 respectively, which co-operate with feelers 101 and 102 respectively arranged on the cylinders 67 and 68. For closing the hold 32 two identical pumps 104 simultaneously driven by an engine 103 pump fluid towards the piston-rod side of the cylinders 67 and 68 through opened valves 105, 106 and opened three-way valves 107, 109. The control-knob 110 controls the engine 103 and the valves 105, 106, 107 and 109. The hydraulic cylinders 67 and 68 should remain energized for holding the hold 32 in the closed state, since the load tends to urge the ship's halves 2 and 3 away from one another. During the loading operation and during transport the hold 32 remains closed, whilst the valves 105, 106, 107 and 109 automatically occupy the closed position, when they are not actuated. For discharging the hold the three-way valves 107 and 109 are set by means of a control-knob 111 so that the fluid passes from the piston-rod ends of the cylinders 67 and 68 simultaneously through conduits 112 towards the other ends of the cylinders under the action of the load pressure of the hold 32. For the evacuation by suction an evacuation-by suction knob 113 actuates only the cylinder 67 by slightly opening the three-way valve 107, a predetermined gap C being thus formed at the front end of the hold 32, however, to an extent such that the ship's halves 2 and 3 are not excessively exposed to torsional effects. For this purpose the piston rod postions of the cylinders 67 and 68 are compared with one another by means of the feelers 101, the amplified signals 117 of which are subtracted one from the other in a comparator 118, the difference signal 119 being compared in a comparator 122 with a signal 121 set in a memory 120 so that in the event of a signal 119 exceeding the signal 121 the three-way valve 107 is set in the closed position. By means of an evacuation-by-suction knob 123 the three-way valve 109 is opened for obtaining a gap C at the rear end of the hold 32. In order to prevent loss of soil shed from the hold 32 due to excessively long actuation of the knobs 113 and 123, the feelers 102 have to close the three-way valves 107 and 109 by co-operating with the trigger elements 100. The control-leads of the feelers 102 to the three-way valves 107 and 109 include switches 124, which can be opened only by means of the control-knob 111.

What we claim is:

1. A dredged soil conveying vessel comprising a hold for receiving dredged soil, for example sand, said hold being enclosed between two pivotally interconnected ship's halves, each of which has floating power and which join one another along the outsides of their bottom rims in the closed state, thus bounding the hold, said ship's halves being pivotable about a horizontal longitudinal axis of the closed state into a discharging position, in which the hold is open on the bottom side and the cargo of dredged soil can be shed out of the hold past between the outsides of said two bottom rims, a discharge suction channel being arranged near the bottom of the hold and communicating with the hold through at least one opening that can be closed, said channel being connected with a slush outlet conduit, characterized in that a discharge suction channel is positioned within at least one ship's half at the inner side of a bottom rim and in that in the hold of the vessel a plurality of water supplies is directed along the walls, said two ship's halves having a pump with a prime mover, only one of the two ship's halves comprising a discharge suction channel and the compression side of the pump in one ship's half communicating through a flexible tubing with the suction side of the pump of the other ship's half, said compression side communicating with the slush outlet conduit.

2. A dredged soil conveying vessel comprising a hold for receiving dredged soil, for example sand, said hold being enclosed between two pivotally interconnected ship's halves, each of which has floating power and which join one another along the outsides of their bottom rims in the closed state, thus bounding the hold, said ship's halves being pivotable about a horizontal longitudinal axis out of the closed state into a discharging position, in which the hold is open on the bottom side and the cargo of dredged soil can be shed out of the hold past between the outsides of said two bottom rims, a discharge suction channel being arranged near the bottom of the hold and communicating with the hold through at least one opening that can be closed, said channel being connected with a slush outlet conduit, characterized in that a discharge suction channel is positioned within at least one ship's half at the inner side of a bottom rim and in that in the hold of the vessel a plurality of water supplies is directed along the walls, said two ship's halves having a discharge suction channel and in that the discharge suction channel of one ship's half communicates through a flexible tubing with a pump mounted in the other ship's half.

3. A dredged soil conveying vessel as claimed in claim 2 characterized in that a pump mounted in one ship's half feeds the water supplies, whereas the pump of the other ship's half is connected with at least one discharge suction channel.

4. A dredged soil conveying vessel comprising a hold for receiving dredged soil, for example sand, said hold being closed between two pivotally interconnected ship's halves, each of which has floating power and which join one another along the outsides of their bottom rims in the closed state, thus bounding the hold, said ship's halves being pivotable about a horizontal longitudinal axis out of the closed state into a discharging position, in which the hold is open on the bottom side and the cargo of dredged soil can be shed out of the hold past between the outsides of said two bottom rims, a discharge suction channel being arranged near the bottom of the hold and communicating with the hold through at least one opening that can be closed, said channel being connected with a slush outlet conduit, characterized in that a discharge suction channel is positioned within at least one ship's half at the inner side of a bottom rim and in that in the hold of the vessel a plurality of water supplies is directed along the walls, characterized in that for adding water during the evacuation of the hold by suction through at least one discharge channel a gap can be formed between the ship's halves, the gap communicating with the outboard water along a sealing strip provided on one of the two ship's halves, said strip releasing, with a given small gap width, a water passage across a longitudinal recess of the other ship's half and forming a seal with respect to a horizontal sealing surface on the other ship's half with a set gap width exceeds said given small gap width.

5. A dredged soil conveying vessel as claimed in claim 4 characterized in that the width of said gap is adjustable.

6. A dredged soil conveying vessel as claimed in claim 5 characterized in that the width of the gap at one end of the hold can be set at a value differing from the gap width at the other end by means of at least two power implements which are adjustable independently one of the other.

7. A dredged soil conveying vessel as claimed in any one of claims 1, 3, 5, 6 or 4 characterized in that the water supplies are arranged at different levels.

8. In a dredged soil conveying vessel having a hold defined in part by bottom wall portions which slope downwardly and inwardly in hopper-like fashion, the vessel including means for discharging material from the bottom of the hold so that such material migrates downwardly in the hold whereby it may form a compacted bridge between said bottom wall portions, the improvement which comprises nozzle means extending downwardly within the hold along the respective bottom wall portions for discharging streams of water deep within the material but along the surfaces of the respective bottom wall portions.

* * * * *